US008075268B1

(12) United States Patent
Liang

(10) Patent No.: US 8,075,268 B1
(45) Date of Patent: Dec. 13, 2011

(54) TURBINE BLADE WITH TIP RAIL COOLING AND SEALING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 701 days.

(21) Appl. No.: 12/238,711

(22) Filed: Sep. 26, 2008

(51) Int. Cl.
*F01D 5/18* (2006.01)

(52) U.S. Cl. ..... 416/97 R; 416/92

(58) Field of Classification Search ..... 416/92, 416/97 R
See application file for complete search history.

(56) References Cited

U.S. PATENT DOCUMENTS

| | | | | |
|---|---|---|---|---|
| 7,473,073 | B1 * | 1/2009 | Liang | 415/173.5 |
| 8,043,058 | B1 * | 10/2011 | Liang | 416/97 R |
| 2005/0111979 | A1 * | 5/2005 | Liang | 416/97 R |
| 2009/0068021 | A1 * | 3/2009 | Liang | 416/97 R |

* cited by examiner

*Primary Examiner* — Alexander Ghyka
(74) *Attorney, Agent, or Firm* — John Ryznic

(57) ABSTRACT

A turbine blade with a single tip rail extending along the mid-chord section of the blade tip from the trailing edge and around the leading edge region offset from the leading edge wall and ending just before the pressure side wall of the airfoil. The tip rail includes a forward side with a concave shaped cross section to form a vortex flow of cooling air on the side of the tip rail. A row of cooling holes discharge cooling air into the vortex flow formed along the concave forward side of the tip rail the tip rail also includes an aft side that is slanted downward to also form a vortex flow. The pressure side wall of the airfoil includes a concave shaped slot extending along the pressure side wall just below the tip corner, and a row of cooling holes to discharge film cooling air upward toward the tip corner.

8 Claims, 3 Drawing Sheets

TURBINE BLADE WITH TIP RAIL COOLING AND SEALING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a turbine blade, and more specifically to a turbine blade with tip cooling and sealing.

2. Description of the Related Art Including Information Disclosed Under 37 CFR 1.97 and 1.98

In a gas turbine engine, especially an industrial gas turbine engine, the turbine includes stages of turbine blades that rotate within a shroud that forms a gap between the rotating blade tip and the stationary shroud. Engine performance and blade tip life can be increased by minimizing the gap so that less hot gas flow leakage occurs.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1 and 2 and includes a squealer tip rail that extends around the perimeter of the airfoil flush with the airfoil wall to form an inner squealer pocket. The main purpose of incorporating the squealer tip in a blade design is to reduce the blade tip leakage and also to provide for improved rubbing capability for the blade. The narrow tip rail provides for a small surface area to rub up against the inner surface of the shroud that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built in along the airfoil pressure side and suction side tip sections and extend from the leading edge to the trailing edge to provide edge cooling for the blade squealer tip. Also, convective cooling holes also built in along the tip rail at the inner portion of the squealer pocket provide additional cooling for the squealer tip rail. Since the blade tip region is subject to severe secondary flow field, this requires a large number of film cooling holes that requires more cooling flow for cooling the blade tip periphery. FIG. 1 shows the prior art squealer tip cooling arrangement and the secondary hot gas flow migration around the blade tip section. FIG. 2 shows a profile view of the suction side each with tip peripheral cooling holes for the prior art turbine blade of FIG. 1. The pressure side is similar in design of the cooling holes as on the suction side.

The blade squealer tip rail is subject to heating from three exposed side: 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow mixing. The effectiveness induced by the pressure film cooling and tip section convective cooling holes become very limited. In addition, a TBC is normally used in the industrial gas turbine (IGT) airfoil for the reduction of blade metal temperature. However, to apply the TBC around the blade tip rail without effective backside convection cooling may not reduce the blade tip rail metal temperature.

BRIEF SUMMARY OF THE INVENTION

It is an object of the present invention to provide for a turbine blade with an improved tip cooling and sealing than the prior art blade tips.

It is another object of the present invention to provide for a turbine blade with less leakage across the tip gap than in the prior art blade tips.

It is another object of the present invention to provide for a turbine blade with a greatly reduced airfoil tip metal temperature so reduce the required amount of cooling flow.

The turbine blade includes a single tip rail that wraps around the blade leading edge diameter and then follows around the airfoil mid-chord contour and terminates at the blade trailing edge. The tip rail forms a flat tip crown with a vortex forming downstream side between the tip rail and the suction side wall. A curved concave upstream side wall of the tip rail forms a vortex forming path in which a cooling air discharge hole passing through the tip cap injects cooling air. A leading edge cooling hole located just below the corner of the forward end of the blade tip injects film cooling air to push the incoming hot gas flow up and over the forward edge of the blade tip.

DETAILED DESCRIPTION OF THE INVENTION

Figure 1:
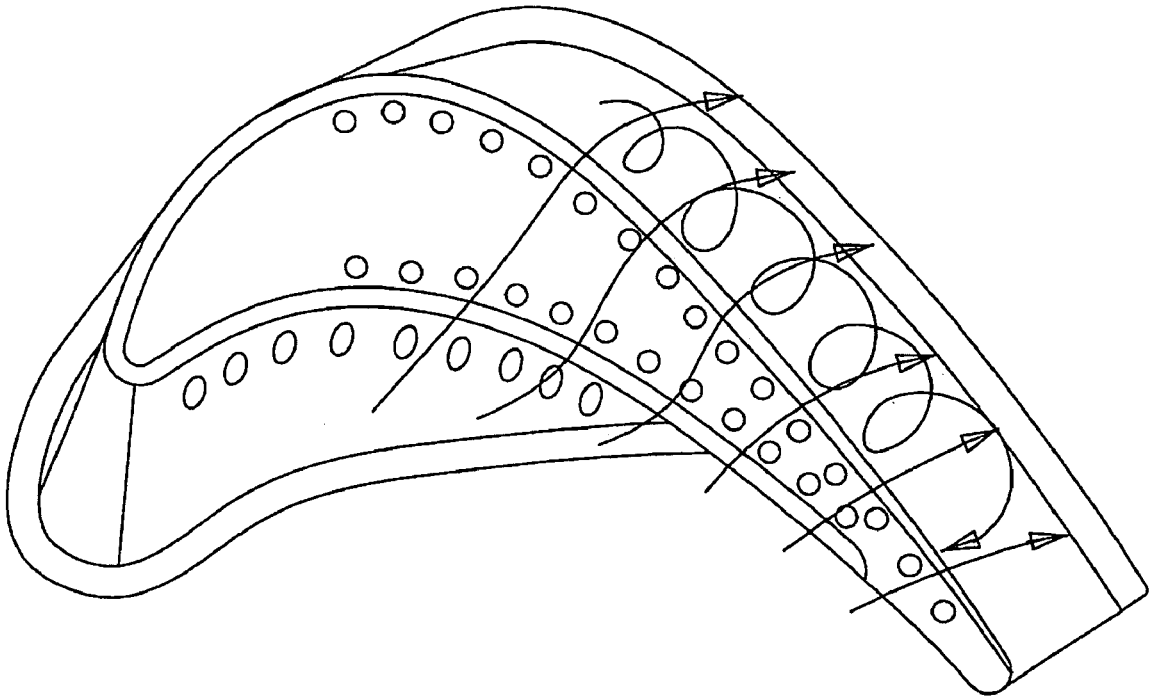
Fig 1 Prior Art
FIG. 1 shows the prior art squealer tip cooling arrangement and the secondary hot gas flow migration around the blade tip section.
Figure 2:
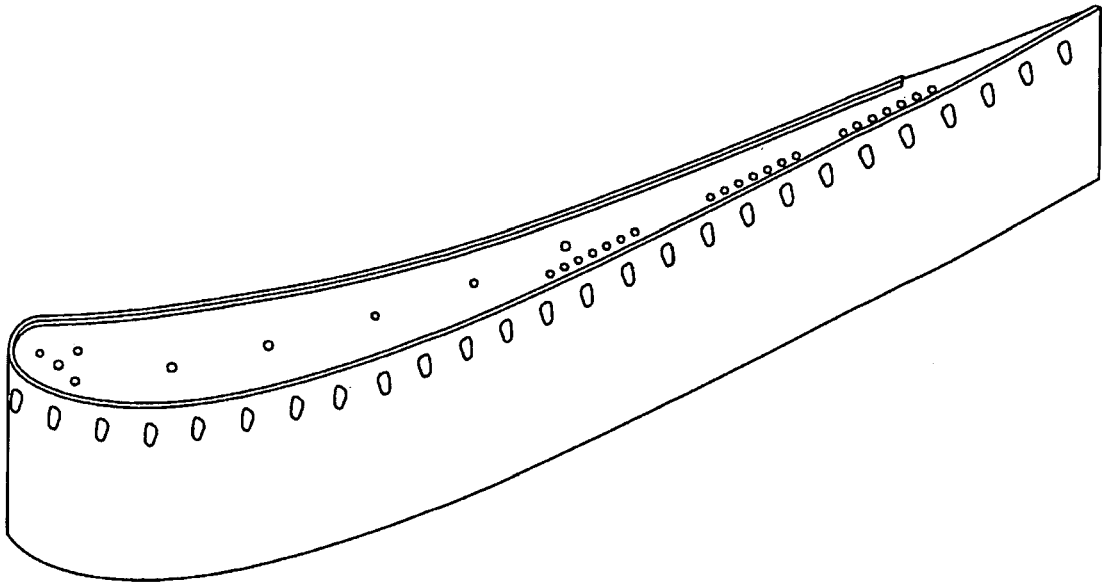
Fig 2 Prior Art
FIG. 2 shows a profile view of the suction side of the prior art blade tip of FIG. 1.
Figure 3:
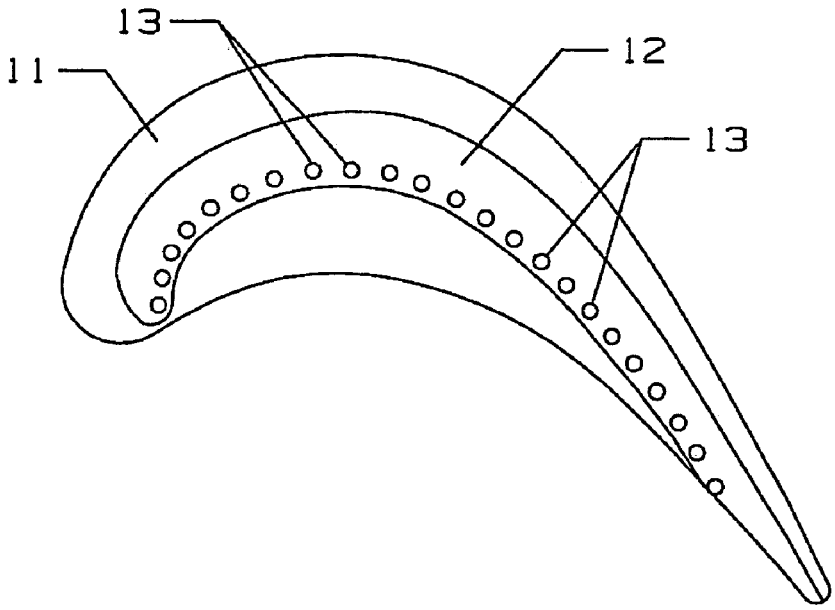
FIG. 3 shows a cross section top view of the blade tip cooling design of the present invention.
Figure 4:
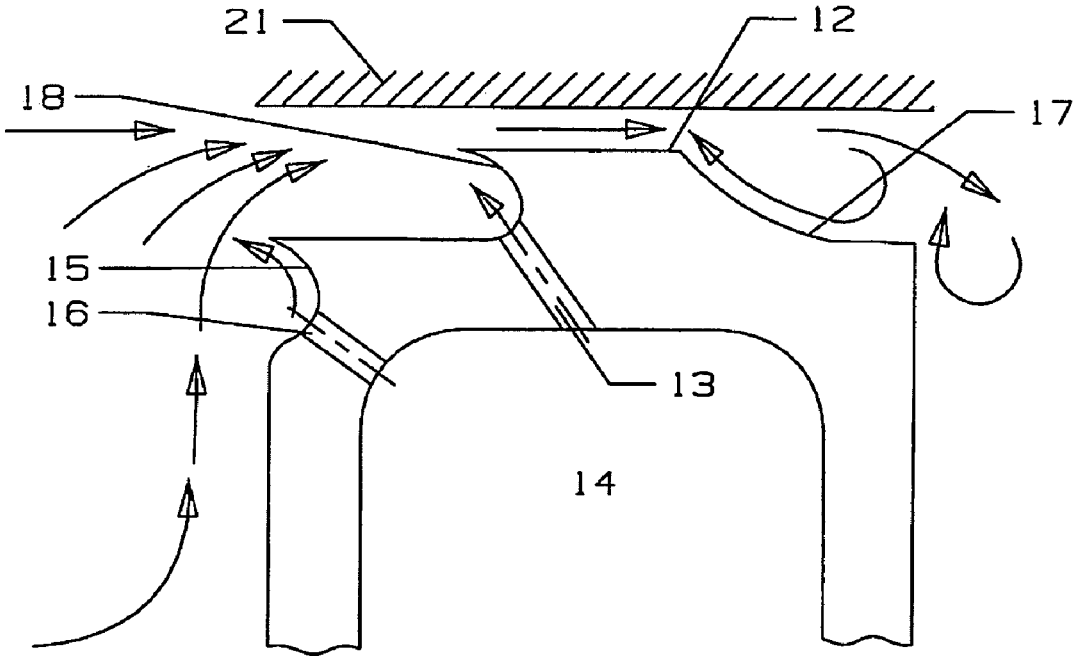
FIG. 4 shows across section side view of the blade tip cooling design of the present invention.

The turbine blade with the tip cooling arrangement of the present invention is shown in FIGS. 3 and 4 with a top view shown in FIG. 3 in which the blade 11 includes an airfoil section having a leading edge and a trailing edge, and a pressure side wall and a suction side wall both extending between the two edges, a single tip rail 12 extends from the trailing edge and follows along the blade mid-chord section toward the leading edge. At the leading edge region, the tip rail bends around toward the pressure side wall and ends just before the wall. Cooling holes 13 open onto a forward or upstream side of the tip rail and connect to the internal cooling air passages of the blade.

FIG. 4 shows a side view through a cross section of the blade tip with the tip rail 12 and cooling holes 13. The blade includes an inner cooling air supply channel 14 which could be one of the legs of a serpentine flow cooling circuit or a single radial cooling supply channel. The tip rail 12 forms a seal with a blade outer air seal 21 formed on the shroud of the turbine. The tip rail 12 includes an aft or downstream side 17 that is slightly concave and slants downward and forms a vortex generating shape so that the flow passing over the tip rail 12 will form a vortex flow as shown by the arrow in FIG. 4. A forward or upstream side 18 of the tip rail 12 includes a concave shaped surface that forms a tip corner pointed in the upstream direction of the hot gas flow over the tip rail 13 as seen in FIG. 4. The tip rail cooling hole 13 opens onto the tip floor to discharge the cooling air substantially parallel to the curved surface of the forward side 18. The cooling holes 13 are connected to the cooling air supply channel 14.

The pressure side of the blade includes a row of film cooling holes 16 connected to the cooling air supply channel 14 and oriented to discharge film cooling air into a concave shaped slot 15 extending along the peripheral of the pressure side wall along the tip corner. The film cooling holes 16 are directed to discharge the film cooling air upward toward the tip corner so as to push the hot gas flow up and over the tip corner as seen by the arrows in FIG. 4.

In operation, due to the pressure gradient across the airfoil from the pressure side to the suction side, the secondary flow near the pressure side surface is migrated from a lower blade span upward across the blade end tip. On the pressure side corner of the airfoil location, the upward pressure side peripheral film cooling holes within the built-in secondary flow deflector will inject cooling air against the secondary leakage flow. This reduces the secondary leakage flow entering the squealer pocket and acts like an air curtain for the blade tip clearance path. Since the squealer tip is offset from the blade pressure side edge, the secondary leakage flow entering the squealer pocket will act like a developing flow with a low heat transfer rate across the blade tip. This enables the injected film cooling flow from the blade pressure side peripheral to establish a well formed film sub-boundary layer over the blade tip surface and thus provide a good film cooling for the floor of the blade tip.

With the offset squealer tip rail, the film cooling flow injected from the airfoil pressure side wall and from the top of the pressure side tip will push the near wall secondary leakage flow outward and against the on-coming stream wise leakage flow first. The combination of the blade leakage flow and the pressure side injection film flow is then pushed upward by the cooling flow injected on the upstream side of the mid-chord tip rail prior to it entering the tip rail squealer channel. In addition to the counter flow action induced by the injection of cooling air into the secondary flow deflector and the slanted forward blade end tip geometry forces the secondary flow to bend outward as the leakage enters the pressure side tip corner and yields a smaller vena contractor to thus reduce the effective leakage flow area. The end result for this combination of effects is to reduce the blade leakage flow that occurs at the blade pressure side tip location.

The enhanced leakage flow resistance of the blade tip geometry and cooling flow injection of the present invention yields a very high resistance for the leakage flow path and thus reduces the blade leakage flow to improve the blade tip section cooling. Thus, the blade tip cooling flow requirement is reduced. Major advantages of the sealing and cooling design of the present invention over the prior art tip rail cooling design are described below. 1) The blade end tip geometry and cooling air injection of the present invention induces a very effective blade cooling and sealing for the blade tip. 2) The upward injection of the cooling flow within the airfoil pressure side tip surface deflector reduces the secondary leakage flow entering the blade tip and induces an air curtain effect for the blade tip leakage path. 3) The secondary flow deflector formed on the forward side surface of the tip mid-chord rail in conjunction with the cooling air injection into the reflector creates a very effective means of deflecting the secondary leakage flow. 4) The concave surface formed on the backside of the tip rail induces a counter vortex flow as the leakage passes through the tip rail. 5) Lower blade tip section cooling air demand due to a lower blade tip leakage flow. 6) Higher turbine efficiency due to a low blade tip leakage flow. 7) Reduction of the blade tip section heat load due to low leakage flow which then increases the blade useful life. 8) The setback squealer tip geometry reduces the heat load for the blade squealer floor as well as the side tip rail. The end effect reduces the tip rail metal temperature as well as thermal gradient through the squealer tip and thus reduces the thermally induced stress and prolongs the blade useful life.

I claim the following:

1. A turbine blade for use in a gas turbine engine, the blade comprising:

an airfoil having a pressure side wall and a suction side wall;

an internal cooling air supply channel formed within the airfoil;

a single tip rail extending from a trailing edge region of the blade tip toward the leading edge region of the blade tip, the single tip rail extending along the blade tip mid-chord region; and, a row of cooling holes connected to the internal cooling air supply channel and opening onto the tip floor adjacent to the forward side of the tip rail.

2. The turbine blade of claim 1, and further comprising:

the forward side of the tip rail is concave shaped in cross section; and, the row of cooling holes are each directed to discharge cooling air into the concave shaped side to form a vortex flow and to direct the cooling air against the hot gas flow leakage across the blade tip.

3. The turbine blade of claim 1, and further comprising:

the tip rail includes an aft side that slants downward toward the suction side wall and forms a vortex flow from the leakage flow over the blade tip.

4. The turbine blade of claim 1, and further comprising:

a concave slot extending along the pressure side wall of the airfoil and just below the tip corner; and, a row of cooling holes connected to the internal cooling supply channel and opening into the concave slot to discharge film cooling air toward the tip corner.

5. The turbine blade of claim 1, and further comprising:

the concave forward side of the tip rail includes a top edge that directs cooling air from the cooling holes in a direction almost parallel to but in an opposite direction to the hot gas flow leakage over the tip rail.

6. The turbine blade of claim 5, and further comprising:

the cooling holes in the concave slot are directed to discharge a layer of film cooling air to push the oncoming hot gas flow up and over the tip corner and into the tip rail gap formed between the tip rail and the blade outer air seal of a gas turbine engine.

7. The turbine blade of claim 1, and further comprising:

the tip rail includes a flat tip crown.

8. The turbine blade of claim 1, and further comprising:

the tip rail curves around the leading edge region and ends just before pressure side wall of the airfoil so that the tip rail is offset from the leading edge wall of the airfoil.

* * * * *